US006854935B2

(12) United States Patent
Andrews

(10) Patent No.: US 6,854,935 B2
(45) Date of Patent: Feb. 15, 2005

(54) METHOD OF REDUCING GROUND DISTURBANCE DURING FREEZE-THAW CYCLES AND A SUBSURFACE INSULATION MATERIAL

(75) Inventor: Maxwell Andrews, P.O. Box 610, Rocky Mountain House, Alberta (CA), T4T 1A5

(73) Assignees: Maxwell Andrews, Rocky Mountain House (CA); Diamond J. Industries Ltd., Rocky Mountain House (CA)

( * ) Notice: Subject to any disclaimer, the term of this patent is extended or adjusted under 35 U.S.C. 154(b) by 0 days.

(21) Appl. No.: 10/393,719

(22) Filed: Mar. 19, 2003

(65) Prior Publication Data

US 2003/0178194 A1 Sep. 25, 2003

(51) Int. Cl.[7] ..... E02D 3/00; E01C 3/00

(52) U.S. Cl. ..... 405/302.4; 405/302.7; 405/258.1; 404/28

(58) Field of Search ..... 404/27, 28, 31, 404/75; 405/302.4, 302.7, 50, 258.1

(56) References Cited

U.S. PATENT DOCUMENTS

| | | | | | |
|---|---|---|---|---|---|
| 1,791,840 | A | * | 2/1931 | Lars | 405/270 |
| 3,561,334 | A | * | 2/1971 | Gerosa et al. | 404/75 |
| 3,722,378 | A | * | 3/1973 | Best | 404/31 |
| 3,839,518 | A | * | 10/1974 | Rubens et al. | 264/45.4 |
| 3,925,993 | A | * | 12/1975 | Roth | 405/302.7 |
| 3,986,781 | A | | 10/1976 | Condo et al. | 404/31 |
| 4,181,448 | A | * | 1/1980 | Crosky | 404/27 |
| 4,597,219 | A | * | 7/1986 | Kropf | 47/1.5 |
| 4,730,953 | A | * | 3/1988 | Tarko | 405/45 |
| 5,195,583 | A | | 3/1993 | Toon et al. | 166/187 |
| 5,346,566 | A | | 9/1994 | White | 156/71 |
| 5,611,400 | A | | 3/1997 | James et al. | 166/293 |
| 5,683,813 | A | | 11/1997 | Davis | 428/400 |
| 6,398,455 | B1 | * | 6/2002 | Volstad | 405/43 |

FOREIGN PATENT DOCUMENTS

| | | | | |
|---|---|---|---|---|
| CA | 2302117 | | 3/2000 | E01C/1/00 |
| JP | 05112904 A | * | 5/1993 | E01C/7/22 |
| WO | WO89/03913 | | 5/1989 | E01C/3/06 |

OTHER PUBLICATIONS

Dow Chemical Canada Inc. product information Styrofoam Brand Highland Insulation, Blueprints' Services, Insulation for Geotechnical Applications, 16 pages, Apr., 2002.

* cited by examiner

*Primary Examiner*—Jong-Suk (James) Lee
*Assistant Examiner*—Lisa M. Saldano
(74) *Attorney, Agent, or Firm*—Christenson O'Connor Johnson Kindness PLLC

(57) ABSTRACT

A method of reducing ground disturbance during freeze-thaw cycles. The steps include excavating soil from an area affected by ground disturbance due to subsurface flow and subsequent freezing of water. A subsurface layer of thermal insulation is then laid over the affected area, thereby thermally insulating the affected area from freezing. The subsurface layer of thermal insulation has a top surface and a bottom surface. A subsurface layer of wick material capable of drawing water away from the affected area by capillary action is also laid parallel to one of the top surface or the bottom surface of the subsurface layer of thermal insulation positioned in a path of the subsurface flow of water.

13 Claims, 5 Drawing Sheets

METHOD OF REDUCING GROUND DISTURBANCE DURING FREEZE-THAW CYCLES AND A SUBSURFACE INSULATION MATERIAL

FIELD OF THE INVENTION

The present invention relates to a method of reducing ground disturbance during freeze-thaw cycles and, in particular, ground disturbances which damage roads and other infrastructure, such as buried utility lines. It also relates to a subsurface insulation material fabricated in accordance with the teachings of the method.

BACKGROUND OF THE INVENTION

Freeze-thaw cycles may result in frost heaves or frost boils, both of which damage roads and other infrastructure, such as buried utility lines.

A frost boil is caused by capillary action of water during freeze-thaw cycles. The capillary action draws dirt long with the water, creating a subsurface cavity which undermines and leads to damage and ultimately the collapse of a road.

A frost heave is caused by absorbent soils. Soils, such as bentonite clay, are capable of absorbing large amounts of water. As the water freezes it expands, pushing the soil underlying a road upwardly and damaging the road.

When conditions exist which lead to frost boils or frost heaves, the frost boils or frost heaves reoccur until a solution is found. Methods currently used to address damage caused by freeze-thaw cycles only repair the damage and do not prevent a reoccurrence of the problem.

SUMMARY OF THE INVENTION

What is required is a method of reducing ground disturbance during freeze-thaw cycles so that roads and other infrastructure will not be damaged.

According to one aspect of the present invention there is provided a method of reducing ground disturbance during freeze-thaw cycles. The steps include excavating soil from an area affected by ground disturbance due to subsurface flow and subsequent freezing of water. A subsurface layer of thermal insulation is then laid over the affected area, thereby thermally insulating the affected area from freezing. The subsurface layer of thermal insulation has a top surface and a bottom surface. A subsurface layer of wick material capable of drawing water away from the affected area by capillary action is also laid parallel to one of the top surface or the bottom surface of the subsurface layer of thermal insulation positioned in a path of the subsurface flow of water.

With the method, as described above, the subsurface layer of thermal insulation is provided to reduce the likelihood of freezing in the temperature ranges at which freeze-thaw cycles normally occur. The subsurface layer of wick material is also provided to draw water away from the affected area by capillary action. Thus moving water away from the affected area, so that there is less likelihood of ground disturbance should the affected area freeze. The use of this method to protect roads and buried infrastructure such as utility lines will hereinafter be further described.

According to another aspect of the present invention there is provided a subsurface insulation material fabricated in accordance with the teachings of the present invention. The subsurface insulation material includes a layered body including with a layer of thermal insulation having a top surface and a bottom surface. A layer of wick material capable of drawing water away from by capillary action is glued to one of the top surface or the bottom surface.

The subsurface insulation material, as described above, has the two key layers necessary according to the teachings of the method described above. The layer of wick material is placed on the top surface or the bottom surface depending upon whether the source of the water originates from above or below the level of the panel. Of course, the layer of wick material can be glued to one surface of the panel and the panel can be oriented in the ground to place the layer of wick material along the top surface or the bottom surface. Beneficial results have been obtained through the use of polyurethane foam insulation in the form of rigid sheets.

Although beneficial results may be obtained through the use of the subsurface insulation material, as described above, water coming from secondary sources (such as an artisian spring) and other directions can be confined by placing a layer of water repelling material glued to the other of the top surface or the bottom surface.

Although beneficial results may be obtained through the use of the subsurface insulation material, as described above, when covering large areas, such as underlying multi-lane highways, it is difficult to do so using a single panel. It is, therefore, necessary to use many panels. However, the object of containing and redirecting the water could be defeated by water seeping around the panels. It is, therefore, preferred that the panels have notches along peripheral side edges that permit the sheets to be placed in side by side overlapping engagement.

Although beneficial results may be obtained through the use of the subsurface insulation material, as described above, there is a danger that the panels placed in side by side overlapping engagement will separate unless there is something to maintain them engaged. Even more beneficial results may, therefore, be obtained when the notch along a first peripheral side edge has a first portion of a mating tape fastener and the notch along the second peripheral side edge has a second portion of the mating tape fastener. This enables the panels to be held together by a mating of the mating tape fasteners. It will be appreciated that other types of interlocking or overlapping fasteners may be used.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
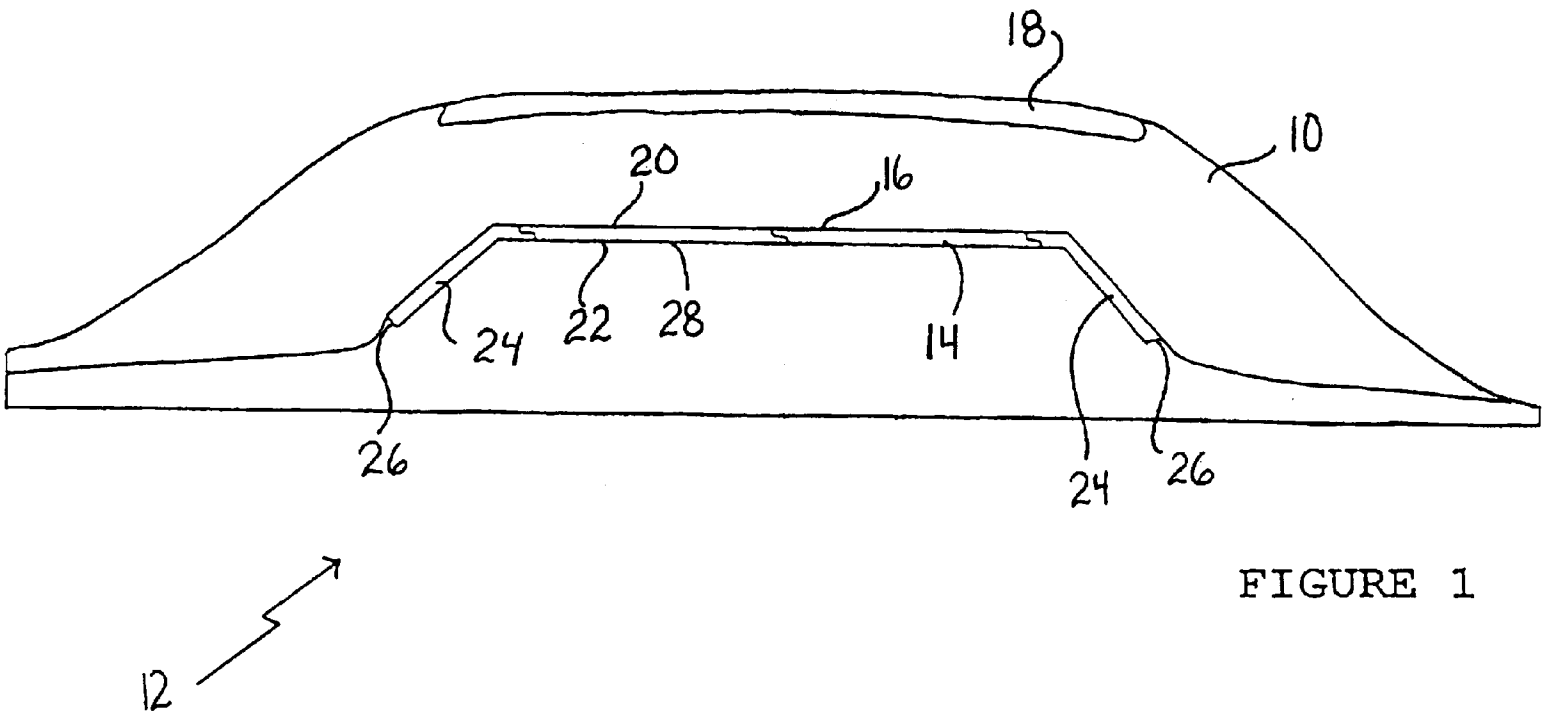
FIG. 1 is an end elevation view, in section, of a road having with an affected area which has been repaired in accordance with the method of reducing ground disturbance during freeze-thaw cycles of the present invention.
Figure 2:
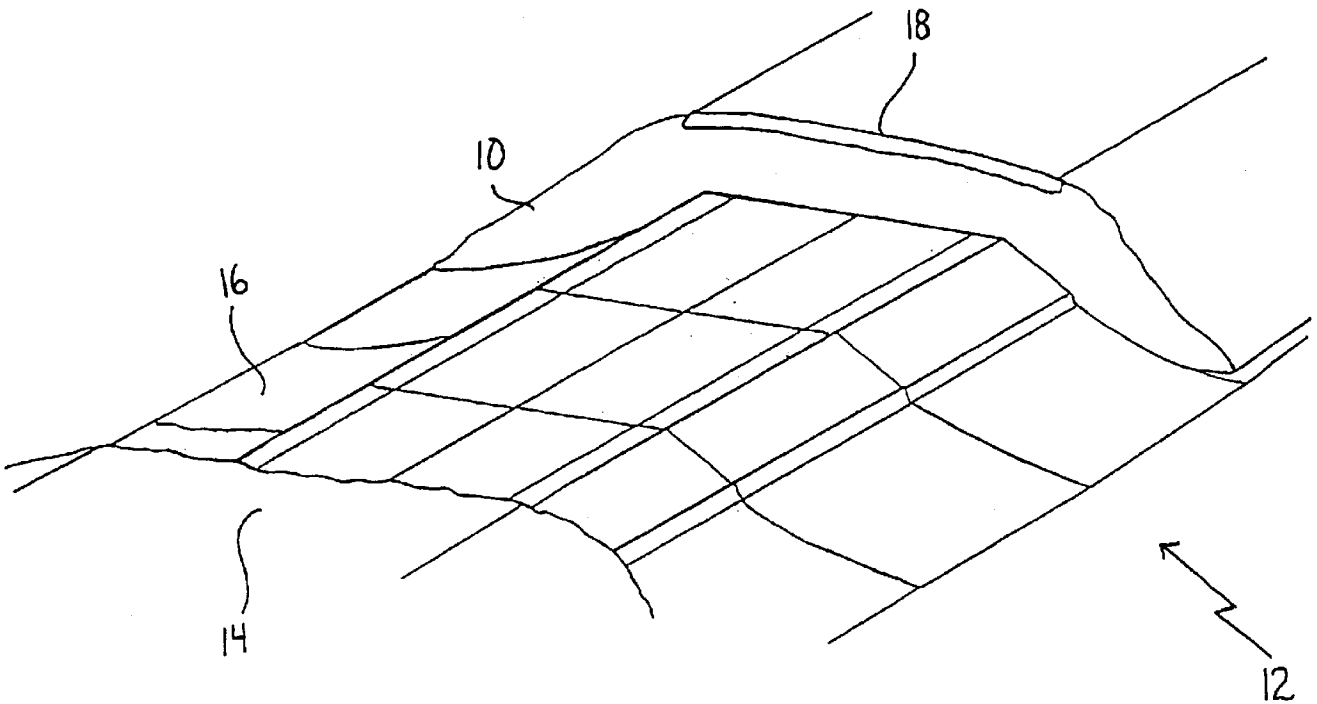
FIG. 2 is a perspective view, partially cut away, of the road illustrated in FIG. 1.

Referring to FIG. 2, the preferred method of reducing ground disturbance during freeze-thaw cycles includes excavating soil 10 from an area, generally referenced by numeral 12, that has been affected by ground disturbance due to subsurface flow and subsequent freezing of water. A subsurface layer of thermal insulation 14 is then laid over affected area 12, thereby thermally insulating affected area 12 from freezing. Referring to FIG. 1, a subsurface layer of wick material 16 that is capable of drawing water away from affected area 12 by capillary action is also laid in a path of the subsurface flow of water. Subsurface layer of thermal insulation 14 is provided to reduce the likelihood of freezing in the temperature ranges at which freeze-thaw cycles normally occur. Subsurface layer of wick material 16 is provided to draw water away from affected area 12 by capillary action. This moves water away from affected area 12, so that there is less likelihood of ground disturbance should affected area 12 freeze.

The best mode of applying this method to the repair of a road will now be described with reference to FIGS. 1 and 2.

Referring to FIG. 2, pavement or gravel travel surface 18 covering affected area 12 is removed. It is recommended that travel surface 18 be removed from an area extending ten meters before and an area extending ten meters after affected area 12. Soil 10 is excavated from affected area 12. Referring to FIG. 1, subsurface layer of thermal insulation 14 is laid over affected area 12, thereby thermally insulating affected area 12 from freezing. In the illustrated embodiment, subsurface layer of thermal insulation 14 has a top surface 20 and a bottom surface 22 and downwardly angled wings 24. Downwardly angled wings 24 prevent frost penetration from peripheral edges 26 of subsurface layer of thermal insulation 14. A subsurface layer of water repelling material 28 is laid parallel to bottom surface 20 of subsurface layer of thermal insulation 14, thereby providing a barrier to the incursion of water from below subsurface layer of thermal insulation 14. Subsurface layer of wick material 16 which is capable of drawing water away from affected area 12 by capillary action, is laid parallel to top surface 22 of subsurface layer of thermal insulation 14 that is positioned in a path of the subsurface flow of water, thereby drawing water originating from the source of water. Soil 10 is then replaced over subsurface layer of wick material 16 that lies parallel to top surface 22 of subsurface layer of thermal insulation 14. After soil 10 is replaced, affected area 12 can then be repaved with travel surface 18.

The best mode of applying this method to the repair of a utility line will now be described with reference to FIG. 5.

Figure 5:
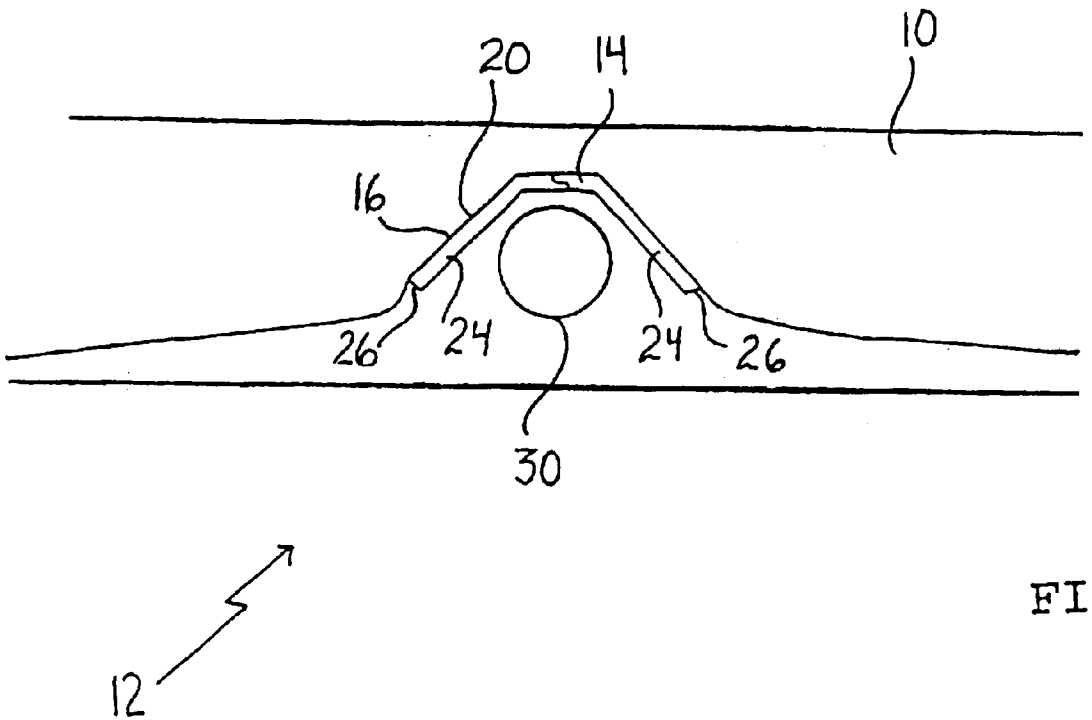
FIG. 5 is an end elevation view, in section, of a utility line having with an affected area which has repaired in accordance with the method of reducing ground disturbance during freeze-thaw cycles of the present invention.

Referring to FIG. 5, there is provided a method of reducing ground disturbance during freeze-thaw cycles which includes excavating soil from an area 12 that affected by ground disturbance due to subsurface flow and subsequent freezing of water. When affected area 12 is along a right of way of a buried utility line 30, soil 10 is excavated to buried utility line 30. Subsurface layer of thermal insulation 14, as described above, is laid over buried utility line 30, thereby thermally insulating affected area 12 from freezing. Downwardly angled wings 24 are provided to prevent frost penetration from peripheral edges 26 of subsurface layer of thermal insulation 14. Subsurface layer of wick material 16, as described above, is laid parallel to top surface 20 of subsurface layer of thermal insulation 14 that is positioned in a path of the subsurface flow of water, thereby drawing water originating from the source of water. Soil 10 is then replaced over subsurface layer of thermal insulation 14 and subsurface layer of wick material 16.

Figure 3:
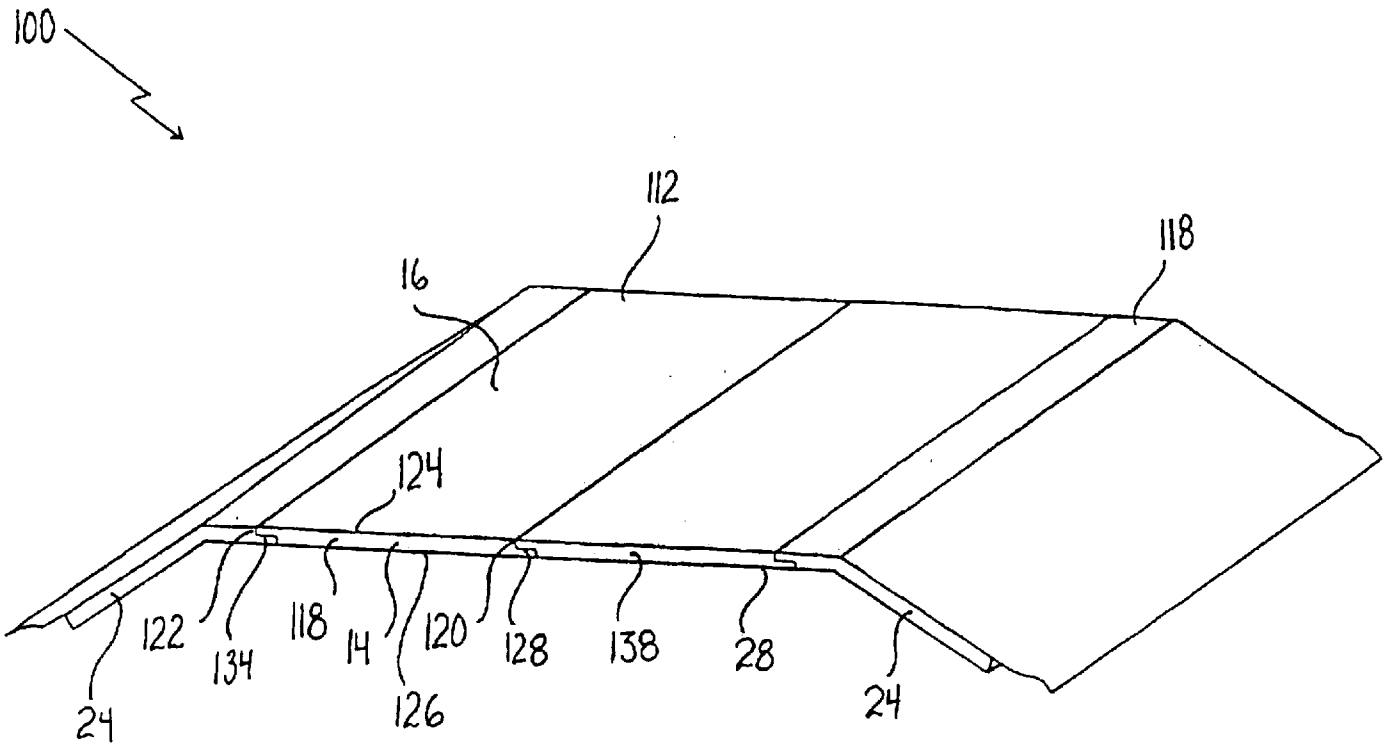
FIG. 3 is a perspective view of the subsurface insulation material used to repair the road illustrated in FIG. 1.
Figure 4:
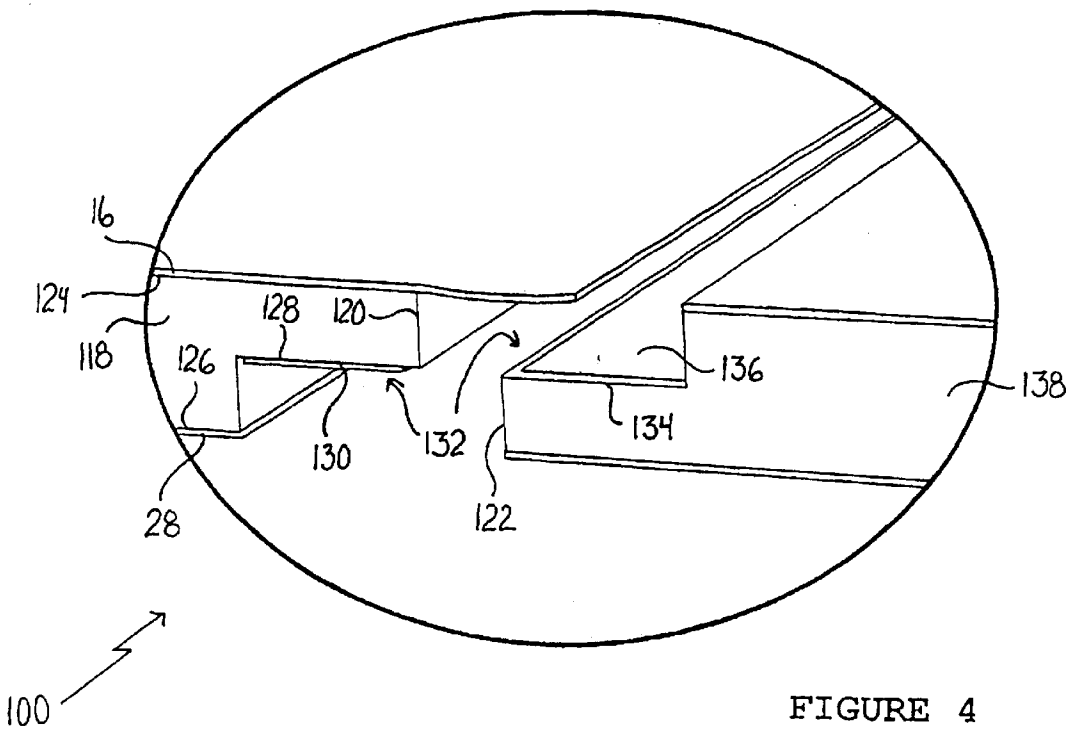
FIG. 4 is a detailed perspective view of connections between adjacent panels of the subsurface insulation material used to repair the road illustrated in FIG. 1.

A subsurface insulation material fabricated in accordance with the teachings of the present invention, and generally indicated by reference numeral 100, will now be described with reference to FIGS. 3 and 4. Subsurface insulation material 100 was developed to speed up installation. Referring to FIG. 3, there is provided a subsurface insulation material 100, which includes a layered body 112 with a layer of thermal insulation 14 in the form of a rigid sheet 118 of polyurethane foam. Sheet 118 has a first side edge 120, a second side edge 122, a top surface 124 and a bottom surface 126. A first notch 128 extends the length of first side edge 120. Referring to FIG. 4, first notch 128 supports a first portion 130 of a mating tape fastener, generally referenced by numeral 132. Referring to FIG. 3, a second notch 134 extends along the length of second side edge 122. Referring to FIG. 4, second notch 134 supports a second portion 136 of mating tape fastener 132. First notch 128 of sheet 118 is adapted to engage second notch 134 of a second sheet 138 when sheet 118 is placed in side by side engagement with second sheet 138. First portion 130 and second portion 136 of mating tape fastener 132 engage to hold sheet 118 to second sheet 138 as illustrated in FIG. 3.

Referring to FIGS. 3 and 4, a layer of non-woven fabric wick material 16 which is capable of drawing water away from by capillary action is glued to top surface 124 and extends past first side edge 120. A layer of water repelling material 28 is glued to bottom surface 126. It will be appreciated that depending on whether source of water originates above or below the level of sheet 118, layer of water repelling material 28 could be glued to top surface 124, and layer of non-woven wick material 16 could be glued to bottom surface 126 instead of as illustrated.

Referring to FIG. 3, some of sheets 118 may be planer, while other of sheets 118 may have angled wings 24. By using sheets 118 which may be secured together, installation can be sped up and affected areas of varying sizes can be accommodated.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the Claims.

The embodiments of the invention in which an exclusive property or privilege is claimed are defined as follow.

1. A method of reducing ground disturbance during freeze-thaw cycles, comprising the steps of:

excavating soil from an area affected by ground disturbance due to subsurface flow and subsequent freezing of water;

laying a subsurface layer of thermal insulation over the affected area, thereby thermally insulating the affected area from freezing, the subsurface layer of thermal insulation having a top surface and a bottom surface, the subsurface layer of thermal insulation also having downwardly angled wings, thereby preventing frost penetration from peripheral edges of the subsurface layer of thermal insulation; and laying a subsurface layer of wick material capable of drawing water away from the affected area by capillary action, the subsurface layer of wick material being parallel to the subsurface layer of thermal insulation and positioned in a path of the subsurface flow of water.

2. The method as defined in claim 1, wherein the affected area is located underlying a road.

3. The method as defined in claim 1, wherein the affected area is located along a right of way of a buried utility line.

4. The method as defined in claim 1, further comprising laying the subsurface layer of wick material along the bottom surface of the subsurface layer of thermal insulation to draw water away from a subsurface flow originating from a source below the subsurface layer of thermal insulation.

5. The method as defined in claim 1, further comprising laying the subsurface layer of wick material along the top surface of the subsurface layer of thermal insulation to draw water away from a subsurface flow originating from a source above the subsurface layer of thermal insulation.

6. The method as defined in claim 1, wherein the subsurface layer of wick material a non-woven fabric.

7. The method as defined in claim 1, wherein the subsurface layer of thermal insulation is polyurethane foam insulation.

8. The method as defined in claim 7, further comprising providing the polyurethane foam insulation in the form of rigid sheets with notches along peripheral side edges that permit the sheets to be placed in side by side overlapping engagement.

9. The method as defined in claim 8, wherein the notches include a notch along a first peripheral side edge having a first portion of a mating tape fastener and a notch along a second peripheral side edge having a second portion of the mating tape fastener.

10. The method as defined in claim 1, further comprising providing a layered panel to facilitate rapid installation which layered panel includes the layer of thermal insulation with the layer of wick material glued to one of the top surface or the bottom surface.

11. The method as defined in claim 10, further comprising gluing a layer of water repelling material to either the either the top surface or the bottom surface which does not have the wick material glued thereon.

12. A method of reducing ground disturbance during freeze-thaw cycles, comprising the steps of:

excavating soil from an area affected by ground disturbance due to subsurface flow and subsequent freezing of water, the soil being excavated to a depth below a source of the subsurface flow of water, the affected area underlying a road;

laying a subsurface layer of thermal insulation over the affected area, thereby thermally insulating the affected area from freezing, the subsurface layer of thermal insulation having a top surface and a bottom surface, the subsurface layer of thermal insulation having downwardly angled wings, thereby preventing frost penetration from peripheral edges of the subsurface layer of thermal insulation;

laying a subsurface layer of water repelling material parallel to the bottom surface of the subsurface layer of thermal insulation, thereby providing a barrier to the incursion of water from below the subsurface layer of thermal insulation; and laying a subsurface layer of wick material capable of drawing water away from the affected area by capillary action, the subsurface layer of wick material being parallel to the top surface of the subsurface layer of thermal insulation positioned in a path of the subsurface flow of water, thereby drawing water originating from the source of water.

13. A method of reducing ground disturbance during freeze-thaw cycles, comprising the steps of;

excavating soil from an area affected by ground disturbance due to subsurface flow and subsequent freezing of water, the affected area being along a right of way of a buried utility line;

laying a subsurface layer of thermal insulation over the buried utility line, thereby thermally insulating the affected area from freezing, the subsurface layer of thermal insulation having a top surface and a bottom surface, the subsurface layer of thermal insulation having downwardly angled wings, thereby preventing frost penetration from peripheral edges of the subsurface layer of thermal insulation; and laying a subsurface layer of wick material capable of drawing water away from the affected area by capillary action, the subsurface layer of wick material being parallel to the top surface of the subsurface layer of thermal insulation positioned in a path of the subsurface flow of water, thereby drawing rater originating from the source of water.

* * * * *

UNITED STATES PATENT AND TRADEMARK OFFICE

CERTIFICATE OF CORRECTION

PATENT NO. : 6,854,935 B2
DATED : February 15, 2005
INVENTOR(S) : M. Andrews

It is certified that error appears in the above-identified patent and that said Letters Patent is hereby corrected as shown below:

Title page,
Insert item:
-- [30] Foreign Application Priority Data
Mar. 20, 2002 (CA) 2377702 --
Item [74], *Attorney, Agent or Firm*, "Christenson" should read -- Christensen --

Column 4,
Line 51, "follow." should read -- follows. --

Column 5,
Line 19, "material a non-woven" should read -- material is a non-woven --
Line 39, "to either the either" should read -- to either --

Column 6,
Line 24, "of;" should read -- of: --
Line 43, "rater" should read -- water --

Signed and Sealed this

Twenty-eighth Day of June, 2005

JON W. DUDAS
*Director of the United States Patent and Trademark Office*